US012404660B2

(12) United States Patent
Parzynski, Jr. et al.

(10) Patent No.: US 12,404,660 B2
(45) Date of Patent: Sep. 2, 2025

(54) DISPERSIBLE WEAR INDICATOR

(71) Applicant: Caterpillar Inc., Peoria, IL (US)

(72) Inventors: David Bruno Parzynski, Jr., Peoria, IL (US); Thomas Marshall Congdon, Dunlap, IL (US); Benjamin Thomas Schafer, Elk River, MN (US)

(73) Assignee: Caterpillar Inc., Peoria, IL (US)

( * ) Notice: Subject to any disclaimer, the term of this patent is extended or adjusted under 35 U.S.C. 154(b) by 720 days.

(21) Appl. No.: 17/723,732

(22) Filed: Apr. 19, 2022

(65) Prior Publication Data

US 2023/0332382 A1 Oct. 19, 2023

(51) Int. Cl.
*E02F 9/26* (2006.01)
*E02F 9/28* (2006.01)

(52) U.S. Cl.
CPC ..... *E02F 9/2883* (2013.01); *E02F 9/26* (2013.01); *E02F 9/2858* (2013.01); *E02F 9/2833* (2013.01)

(58) Field of Classification Search
CPC ..... E02F 9/2883; E02F 9/26; E02F 9/2858; E02F 9/2833; E02F 9/2808
See application file for complete search history.

(56) References Cited

U.S. PATENT DOCUMENTS

| | | | | |
|---|---|---|---|---|
| 3,578,092 | A * | 5/1971 | Tesch | B23Q 17/0957 175/39 |
| 7,424,936 | B2 * | 9/2008 | McClellan | F16D 66/028 188/1.11 R |
| 9,194,089 | B2 | 11/2015 | Jeevanantham et al. | |
| 10,640,299 | B1 | 5/2020 | Szazdi, Jr. | |
| 11,111,655 | B2 | 9/2021 | Pratt | |
| 2005/0263735 | A1 * | 12/2005 | Minor | C07C 49/167 252/68 |
| 2011/0162241 | A1 | 7/2011 | Wangsness | |
| 2014/0102791 | A1 * | 4/2014 | Dupont | E21B 12/02 175/39 |
| 2014/0173948 | A1 * | 6/2014 | Ok | E02F 9/2808 29/402.08 |
| 2019/0316329 | A1 | 10/2019 | Pratt | |

FOREIGN PATENT DOCUMENTS

| | | | |
|---|---|---|---|
| EP | 3794923 | A1 | 3/2021 |
| WO | 2005045142 | A1 | 5/2005 |

* cited by examiner

*Primary Examiner* — Christopher J Sebesta
*Assistant Examiner* — Robert E Pezzuto

(57) ABSTRACT

A wear member includes an attachment portion, and a wear portion extending from the attachment portion that defines a wear surface. The wear portion has a dispersible wear indicator that is disposed in the wear portion, and that is spaced a predetermined distance away from the wear surface.

21 Claims, 7 Drawing Sheets

DISPERSIBLE WEAR INDICATOR

TECHNICAL FIELD

The present disclosure relates to wear members attached to the work implements of heavy equipment such as cold planers, bulldozers, mining equipment, and the like. Specifically, the present disclosure relates to wear members that have wear indicators.

BACKGROUND

In industries such as the earthmoving, mining, construction, paving, and agriculture industries, etc., work implements such as buckets, blades, shovels, grapples, shears, etc. have ground engaging tools such as shrouds, sliders or skids, cutting edges, etc. are used to encounter a work material such as rocks, dirt, asphalt, etc. In general the ground engaging tools and other wear members are attached to provide a buffer between the work material and the work implement to extend the useful life of the work implement. At some point in time, the wear member is worn away and needs to be replaced.

U.S. Pat. Appl. Publ. No. 2011/0162241 A1 discloses a wear indicator on a tool that is provided to determine if a blade or edge of a tool is worn past a predetermined point. It provides for the easy identification of the condition of replacement wear surfaces. The wear indicator or marking may be implemented in many ways that will not interfere or impede in the integrity of the blade or tool. Some examples include laser etching of the mark, a line pressed into the surface of the blade, dimples along a line, a scribe mark, a paint, a material located inside of the product that becomes visible when the part is to be replaced, or any other suitable way to easily and visually determine the condition of the blade.

These known wear indicators require the operator of a machine using such work tools or wear members to visually inspect the wear member to determine its condition. This may require machine downtime, or even disassembly of the equipment in order to see the wear indicator. For example, cold planer attachments used with paving equipment cannot always be seen during use since they are obstructed by various components of the cold planer attachment. This may require disassembly of the attachment in order to see the condition of the wear indictors, necessitating a prolonged amount of downtime for the machine which is undesirable for an economic endeavor employing the machine.

Accordingly, wear indicators that may be observed without requiring machine downtime are needed.

SUMMARY

A wear member according to an embodiment of the present disclosure includes an attachment portion, and a wear portion extending from the attachment portion that defines a wear surface. The wear portion may have a bleeding wear indicator that is disposed in the wear portion, and that is spaced a predetermined distance away from the wear surface.

A skid for use with a cold planer assembly according to an embodiment of the present disclosure may comprise a sliding portion including a sliding surface, and a connecting portion extending from the sliding portion that is thinner than the sliding portion. The sliding portion may include a first dispersible wear indicator positioned in the sliding portion away from the sliding surface.

A method of alerting that a wear member needs to be replaced according to an embodiment of the present disclosure may comprise forming a wear member that includes a dispersible wear indicator or a bleeding wear indicator.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings:

FIG. 6 is a perspective view of another embodiment of a heel shroud similar or identical to that of FIG. 3 except that durability enhancements are added such as chocky bars or the like.

DETAILED DESCRIPTION

Figure 1:
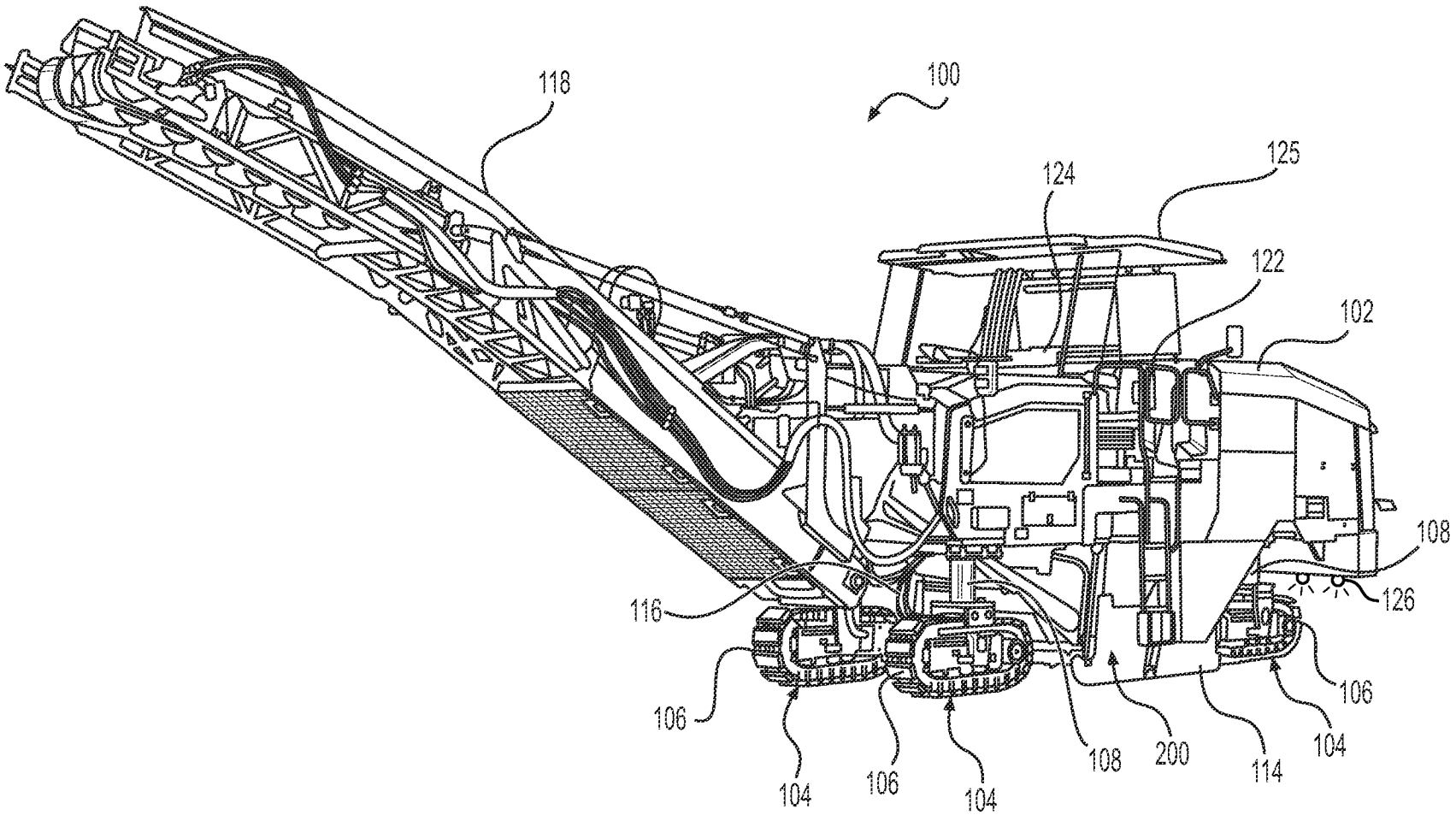
FIG. 1 illustrates a machine in the form of a cold planer with a cold planer attachment assembly having wear members with a bleeding wear indicator constructed according to the various embodiments disclosed herein.

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100a, 100b etc. It is to be understood that the use of letters immediately after a reference number indicates that these features are similarly shaped and have similar function as is often the case when geometry is mirrored about a plane of symmetry. For ease of explanation in this specification, letters will often not be included herein but may be shown in the drawings to indicate duplications of features discussed within this written specification.

While the arrangement is illustrated in connection with a cold planer attachment assembly being used by a skid steer, the arrangement disclosed herein has universal applicability in various other types of machines commonly employ track systems, as well wheels. The term "machine" may refer to any machine that performs some type of operation associated with an industry such as mining, earthmoving, or construction, paving, or any other industry known in the art. For example, the machine may be a skid steer as shown, a paver, an excavator, a wheel loader, a cable shovel, or a dragline or the like. Moreover, one or more implements may be connected to the machine. Such implements may be utilized for a variety of tasks, including, for example, lifting, loading, pushing and paving.

FIG. 1 illustrates an exemplary machine 100 having multiple systems and components that cooperate to accomplish a task. Machine 100 may embody a mobile machine that performs some type of operation associated with an industry such as mining, construction, farming or agriculture, transportation, earth moving, or any other known industry. For example, machine 100 may be a milling machine such as a cold planer. Machine 100 may include a power source 102 and one or more undercarriage assembly 104, which may be driven by power source 102.

Power source 102 may drive the undercarriage assembly(s) 104 of machine 100 at a range of output speeds and torques. Power source 102 may be an engine such as, for example, a diesel engine, a gasoline engine, a gaseous fuel-powered engine, or any other suitable engine. Power source 102 may also be a non-combustion source of power such as, for example, a fuel cell, a power storage device, or any other source of power known in the art.

Undercarriage assembly(s) 104 may include crawler tracks 106. The undercarriage assemblies 104 may be attached to the machine 100 via hydraulic cylinders 108 that may be raised or lowered or rotated to position the machine 100 vertically and/or horizontally at a desired position relative to a work surface. Other types of undercarriages may be employed such as those employing wheels, walking mechanisms, etc.

An implement assembly in the form of a cold planer attachment assembly 200, which includes a rotary cutting drum assembly or ripping subassembly 204 (best seen in FIG. 2), is shown to be attached to and extend from the bottom of the machine 100 in FIG. 1 such that it can hover a desired distance above the work surface. The implement assembly 110 includes two hydraulic side plates 114 (see FIG. 2) with position sensors (not shown) used to monitor and position the rotary cutting drum assembly or ripping subassembly 204 (shown in FIG. 2). A cover plate 201 (see FIG. 2) extending between the side plates 114 is often employed to partially surround the rotary cutting drum assembly 112, being positioned above and to the rear of the cutting drum. A transmission (not shown) may be operatively connected to the power source 102 and the rotary cutting drum assembly or ripping subassembly, allowing the power source 102 to drive the rotary cutting drum assembly or ripping subassembly to rotate and rip up the work surface.

Figure 2:
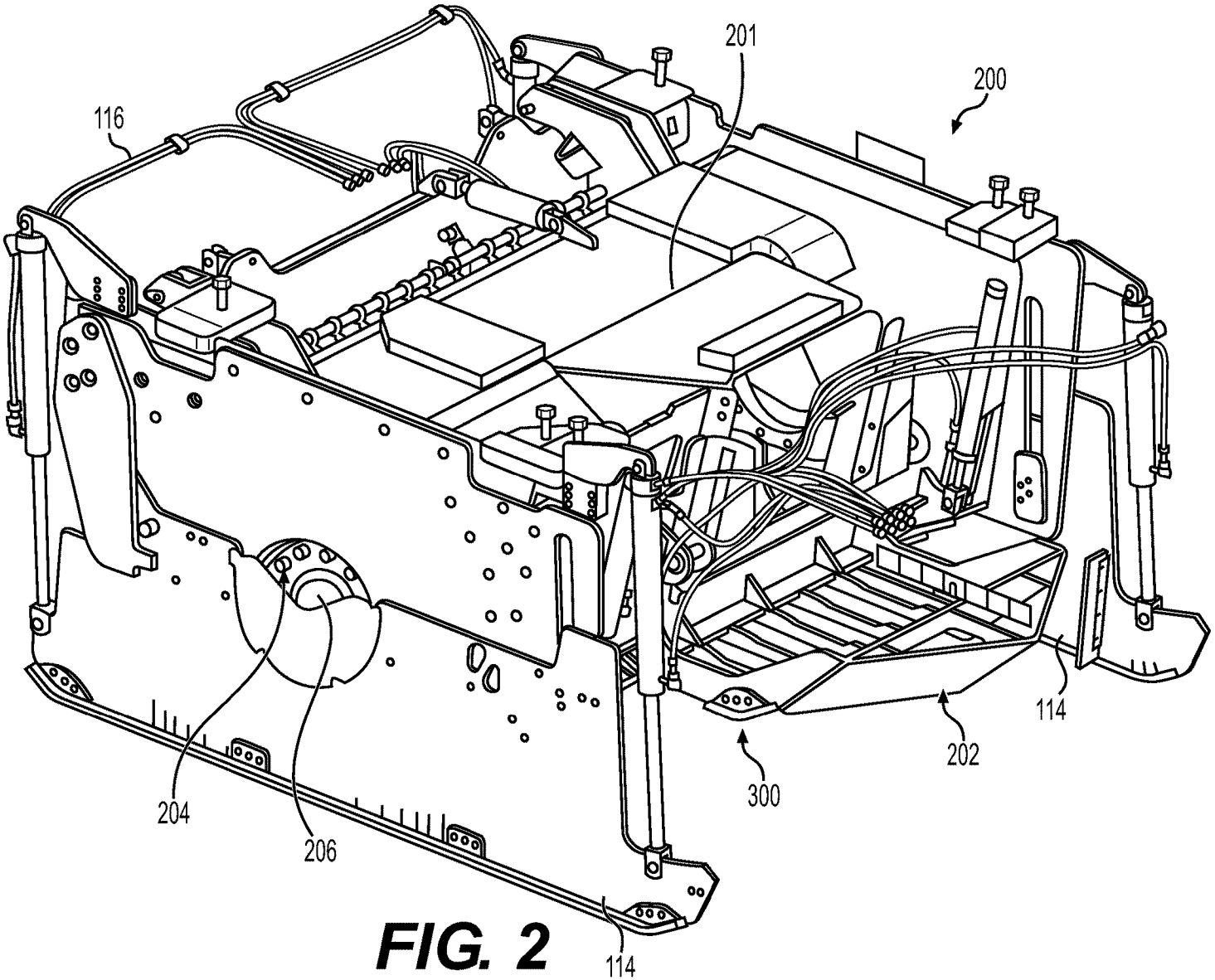
FIG. 2 is a perspective view of the cold planer attachment assembly of FIG. 1 with its front portion removed, revealing wear members such as skids or sliders that use a bleeding wear indicator according to an embodiment of the present disclosure.

As shown in FIG. 2, the cold planer attachment assembly 200 is fitted with hydraulic hoses 116 to feed water that is sprayed onto the rotary cutting drum assembly or ripping subassembly 204, helping to remove debris from the vicinity in use. This debris is diverted by the machine 100 to a foldable conveyor system 118 (see FIG. 1) that transports the material to another vehicle or dump site where the discarded material is hauled away from the work area.

In FIG. 1, a cab 120 is also shown that houses a seat 122 and controls 124 for the operator to use to control the various functions of the machine 100. For example, the operator may use these controls to manipulate the assembly 200 for ripping up pavement such as asphalt as shown, paving, pushing material, digging, excavating, or any other suitable application. The configuration of this machine as well as the cold planer attachment assembly 200 may be varied as needed or desired. The machine of FIG. 1 is provided by way of an example only as other types of machines are considered to be within the scope of the present disclosure. For example, a cold planer attachment assembly 200 by be used by a skid steer, etc.

Figure 3:
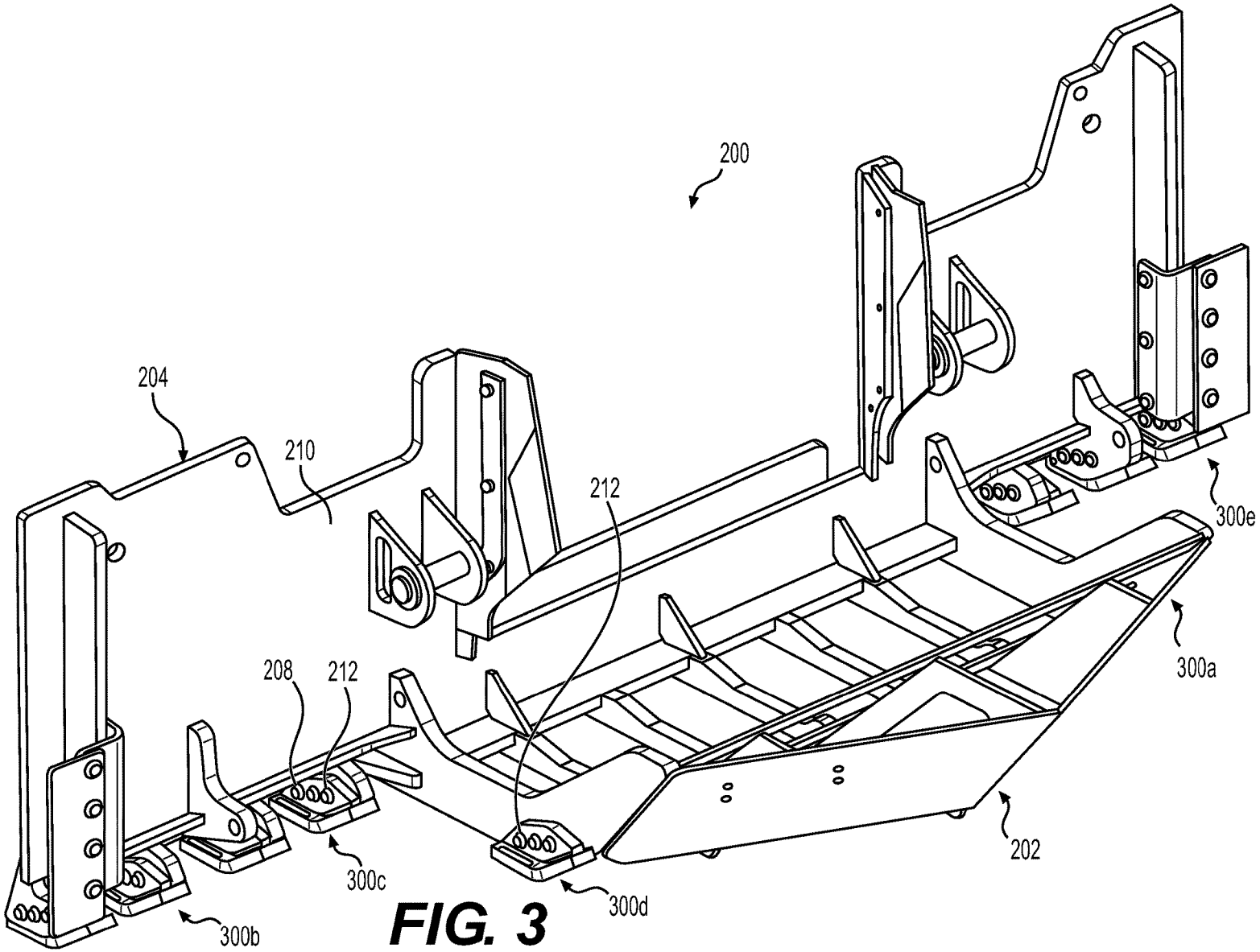
FIG. 3 illustrates the cold planer attachment assembly of FIG. 2 with more components removed, revealing more wear members such as skids or sliders that use a bleeding wear indicator according to various embodiments of the present disclosure.
Figure 4:
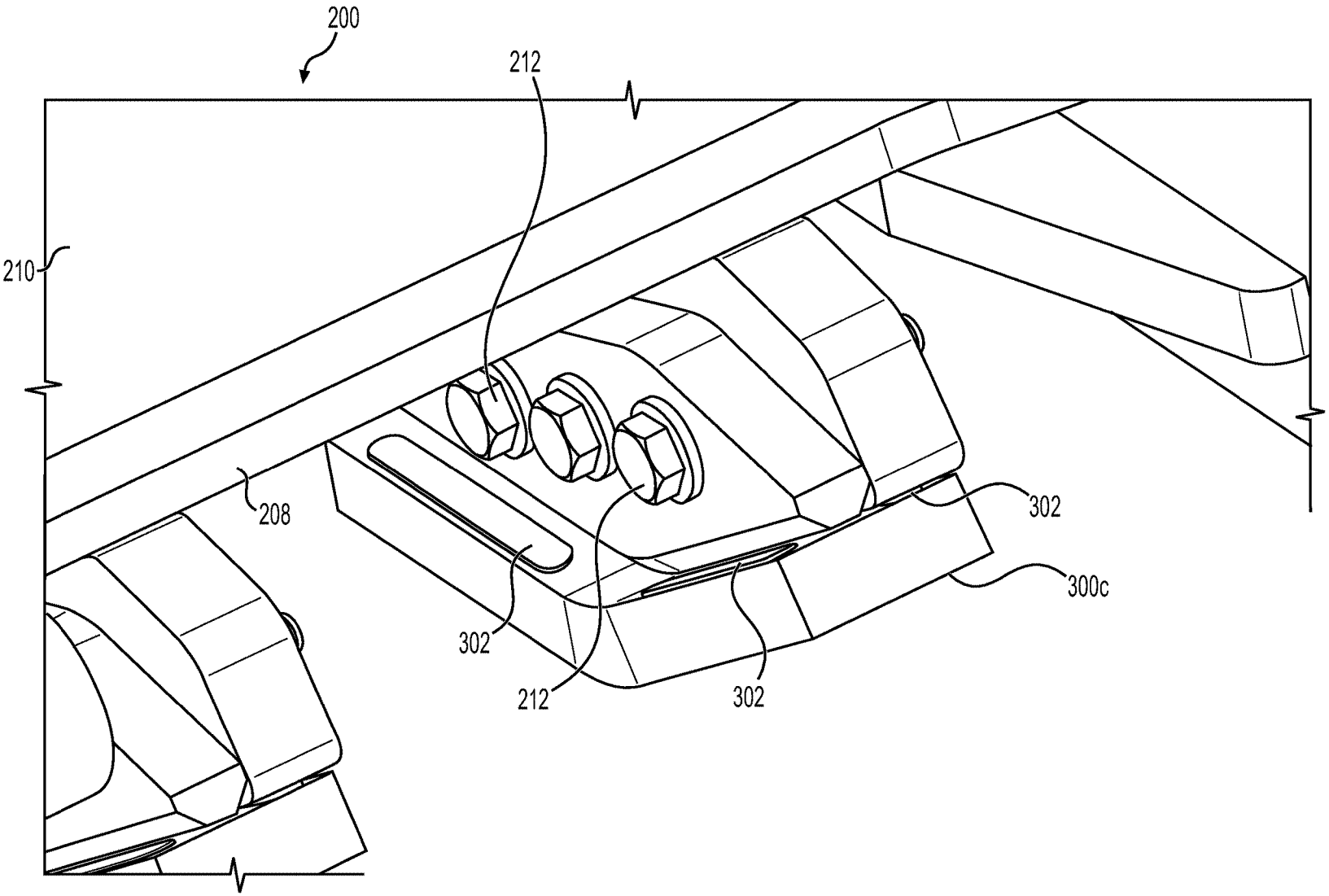
FIG. 4 is an enlarged detail view of a wear member attached to the assembly of FIG. 3.

Looking at FIGS. 2 thru 4, the cold planer attachment assembly is shown in progressively greater detail, with various components of the assembly removed to aid the reader in understanding its construction, and the wear members (e.g., skids) that may have a wear indicator constructed according to various embodiments of the present disclosure.

FIG. 2 has the front portion removed, revealing a blade like structure 202 with skids 300 that are positioned in front of the ripping subassembly 204 that may have bits (not shown) for ripping up paved surfaces such as asphalt, concrete, etc. A hydraulic motor 206 may rotate a drum (not shown) on which the bits are attached to rip up the paved surface. The skids 300 may contact the work surface or the paved surface and are prone to wear. The skids may be attached to the blade like structure or other frame members of the assembly via welding, fastening (as shown in FIGS. 3 and 4), etc.

Referring to FIG. 3, a pair of skids 300, 300*a* are shown to be attached to the blade like structure. Similarly or identically configured skids 300*b*, 300*c*, 300*d*, 300*e*, etc. to those just described are also attached to a bottom frame member(s) 208 that is attached to the front panel 210 of the ripping subassembly 204.

An instance of a skid 300*c* is best shown in FIG. 4 as being attached to a bottom frame member 208 using fasteners 212. Wear indicators 302 are shown that may indicate to an operator other personnel in the work area that the skid needs to be replaced as will be discussed in more detail later herein.

Figure 5:
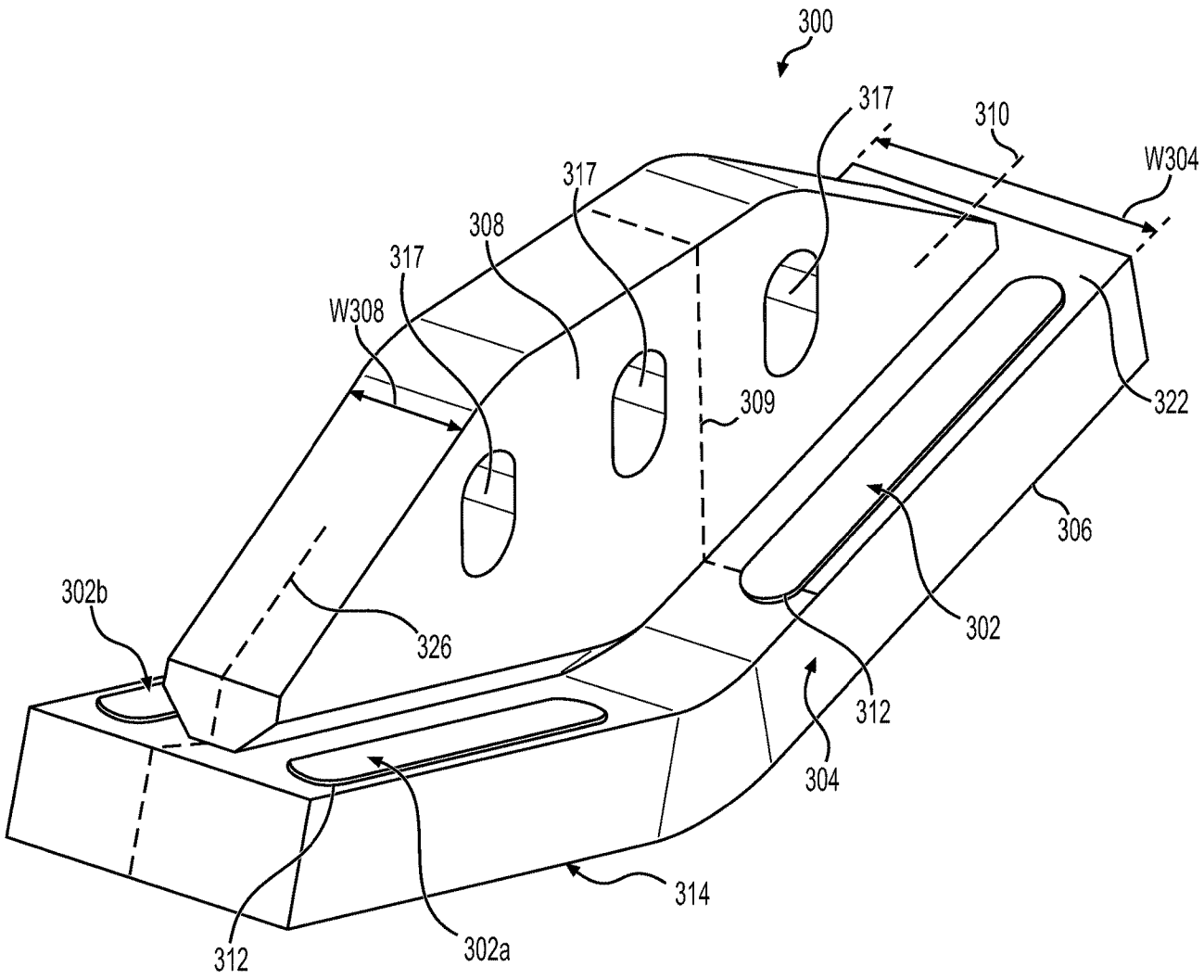
FIG. 5 is a perspective view of the wear member of FIG. 4 shown in isolation.
Figure 6:
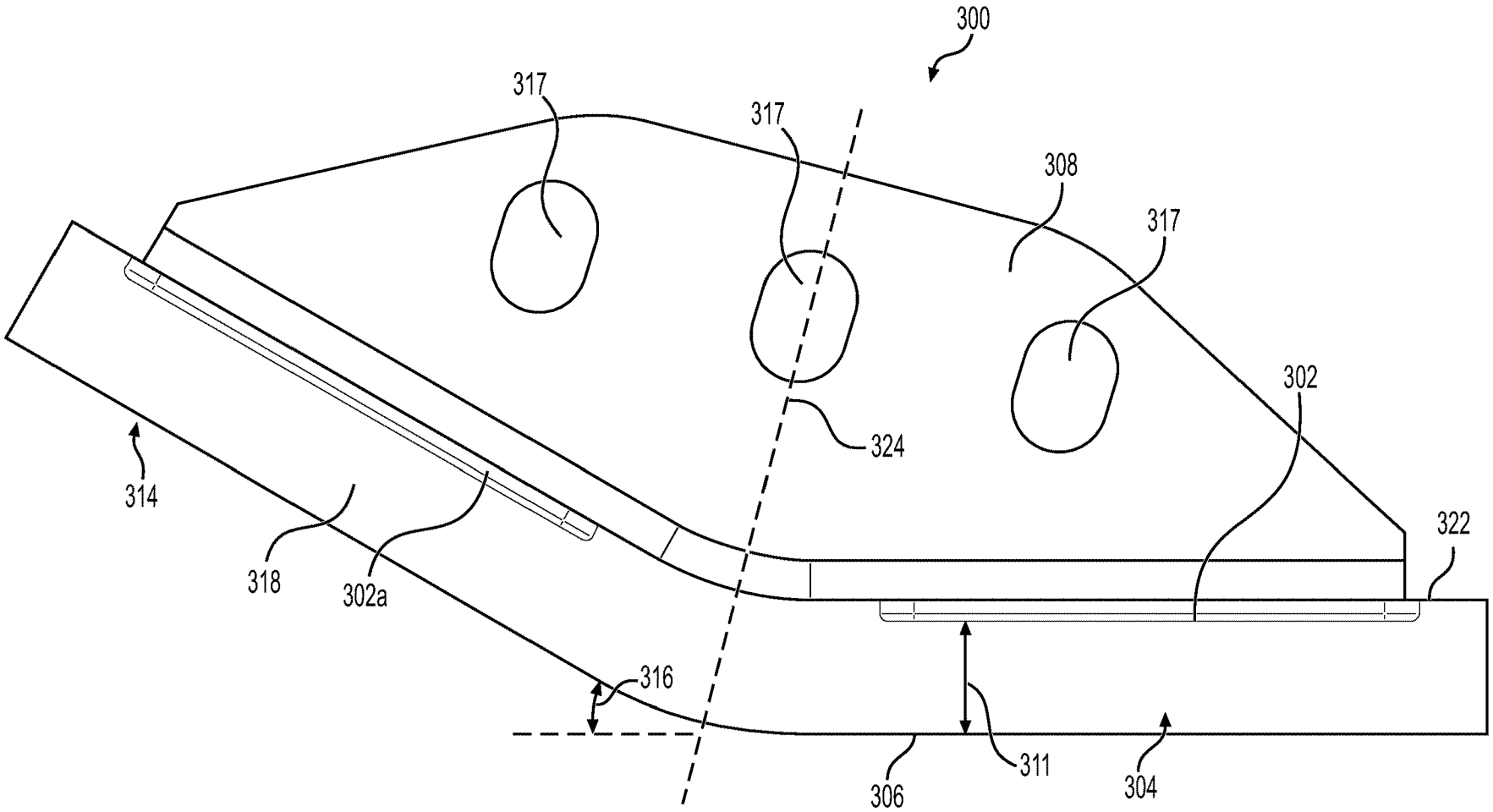

Turning now to FIGS. 5 and 6, various embodiments of a skid (and in a more general sense a wear member) that have one or more wear indicators will be described now in detail.

The skid 300 may comprise a sliding portion 304 including a sliding surface 306 (i.e., a bottom surface that contacts or slides on the work material such as asphalt, etc.), as well as a connecting portion 308 that may extend from the sliding portion 304, and that is thinner than the sliding portion 304.

More specifically, the connecting portion 308 (which may also be referred to as an attachment portion since this portion is used to attach the skid or wear member to some other structure via fasteners inserted through a plurality of thru-holes 317, via welding, etc.) may define an attachment portion width W308, while the sliding portion 304 (which may also be referred to as a wear portion since this portion wears as this portion slides) defines a wear portion width W304 that is greater than the attachment portion width W308.

This may yield an at least partially "T shape" 309 in a cross-section parallel to the wear portion width W304 and the attachment portion width W308. As shown in FIG. 5, the attachment portion (or connecting portion 308) may be disposed at a midpoint 310 along the wear portion width W304. This may not be the case for other embodiments of the present disclosure.

The sliding portion 304 may include a first dispersible wear indicator 302 (may also be referred to as a bleeding wear indicator since the substance from which the wear indicator is made may bleed or leach into the working material, etc.) positioned in the sliding portion 304 away from the sliding surface 306 as represented by distance 311. More particularly, the first dispersible wear indicator 302 may have an elongated racetrack perimeter 312 (so called since the perimeter has two flat sides that are joined by semicircles), but not necessarily so. For example, other shaped perimeters may be employed including rectangular, circular, elliptical, polynomial, etc. In some embodiments, the first dispersible wear indicator comprises at least one of the following: a paint, a polymer, a dissolvable solid, and a fluid, etc.

Also, a ramp portion 314 may be provided that extends from the sliding portion 304 at an oblique angle 316 to the sliding portion 304. This ramp portion may also be referred to as a "push portion", a "deflector portion", etc. as it moves material or debris out of the way of the skid, underneath the skid, etc. So, the ramp portion may include a bottom surface that acts as a push surface 318.

With continued reference to FIGS. 5 and 6, the ramp portion may include a second dispersible wear indicator 302*a* that is disposed in the ramp portion 314, and that is spaced away from the push surface 318 in a similar manner as the first dispersible wear indicator 302 is spaced a predetermined distance 311 away from the sliding surface 306. This may not be the case for other embodiments of the present disclosure.

Also, the sliding portion 304 may include a top exposed surface 322 (may be planar and parallel to the sliding surface 306), and the first dispersible wear indicator 302 may be disposed at the top exposed surface 322 of the sliding portion 304 proximate to the connecting portion 308 (or attachment portion). For example, the wear indicator may be disposed inside of the sliding portion or wear portion away from any exposed surface, etc.

To provide ease and flexibility in use and during assembly, the first dispersible wear indicator 302 may be symmetrical to the second dispersible wear indicator 302*a* about a first plane of symmetry 324 as shown in FIG. 6. In addition as shown in FIG. 5, the skid 300 may further comprise a third dispersible wear indicator 302*b*, and a fourth dispersible wear indicator (not shown in FIGS. 5 and 6 but understood to be present by looking at FIG. 4) that are symmetrical to the first dispersible wear indicator 302, and the second wear indicator 302*a* about a second plane of symmetry 326. Consequently, the ramp portion may become the sliding portion, and the left side may become the right side, depending on how the user attaches the skid 300 to the assembly 200 without changing the desired performances. One or more symmetries may not be present in other embodiments of the present disclosure.

In a more general sense, the skid 300 may be referred to as a wear member and its construction or associated principles may be applied to other types of wear members such as shrouds, tips, and cutting edges, etc.

Still referring to FIGS. 5 and 6, a wear member (e.g., skid 300) may comprise an attachment portion (e.g., see 308), and a wear portion (e.g., see 304) extending from the attachment portion that defines a working surface or a wear surface (may take the form of a sliding surface 306 or another surface that contacts a work material such as asphalt, dirt, rocks, etc.). A bleeding wear indicator (e.g., see 302) may be disposed in the wear portion, and may be spaced a predetermined distance 311 away from the wear surface.

As alluded to earlier herein, the bleeding or dispersible wear indicator may comprise at least one of the following: a paint, a polymer, a dissolvable solid, and a fluid etc.

In certain embodiments, the bleeding wear indicator includes a fluid that comprises at least one of the following: a colored liquid, and a colored gas. When the working material contacts or exposes the liquid or gas, the liquid may be seen on the work material, or the gas may be seen in the vicinity of the work area, alerting the operator or other personnel in the area that a wear member needs to be replaced.

In other embodiments the bleeding or dispersible wear indicator may include a dissolvable solid that is water soluble. When the working material contacts the dissolvable solid, the moisture content of the working material (e.g., as would be the case for oilsands applications) will cause the solid to disperse or bleed into the working material, alerting that a wear member needs to be repaired or replaced.

In some embodiments, the bleeding or dispersible wear indicator includes a paint that is yellow, or a polymer that is yellow. Other noticeable colors may be employed including red, orange, etc.

As depicted in FIGS. 5 and 6, the bleeding or dispersible wear indicator (e.g., see 302, 302*a*, 302*b*, 302*b*) may be disposed nearer the attachment portion (e.g., see 308) as opposed to the wear surface (e.g., see 306). The opposite may be true in other embodiments of the present disclosure.

The skid or wear member may be a unitary body as shown or be an assembly of different parts including enhanced wear members (e.g., chocky blocks, wear buttons, etc.), mounting plates, etc. Often, the skid or wear member consists essentially of a metallic material such as cast iron, steel, grey cast iron, etc.

Any of the aforementioned features and their associated dimensions may be altered to be different than what has been shown or mentioned herein in other embodiments of the present disclosure.

INDUSTRIAL APPLICABILITY

In practice, a work implement, a skid, and/or a wear member or a portion thereof may be sold, manufactured, bought etc. and attached to the machine in the aftermarket or original equipment scenarios according to any of the embodiments discussed herein. That is to say, the machine may be sold with the work implement, a skid, and/or a wear member and/or a portion thereof according to embodiments described herein or the machine may be retrofitted, repaired, refurbished to use any of the embodiments discussed herein. The various components including, but not limited to the skids, may be fabricated from any suitable material such as cast iron, grey cast iron, steel, etc.

Figure 7:
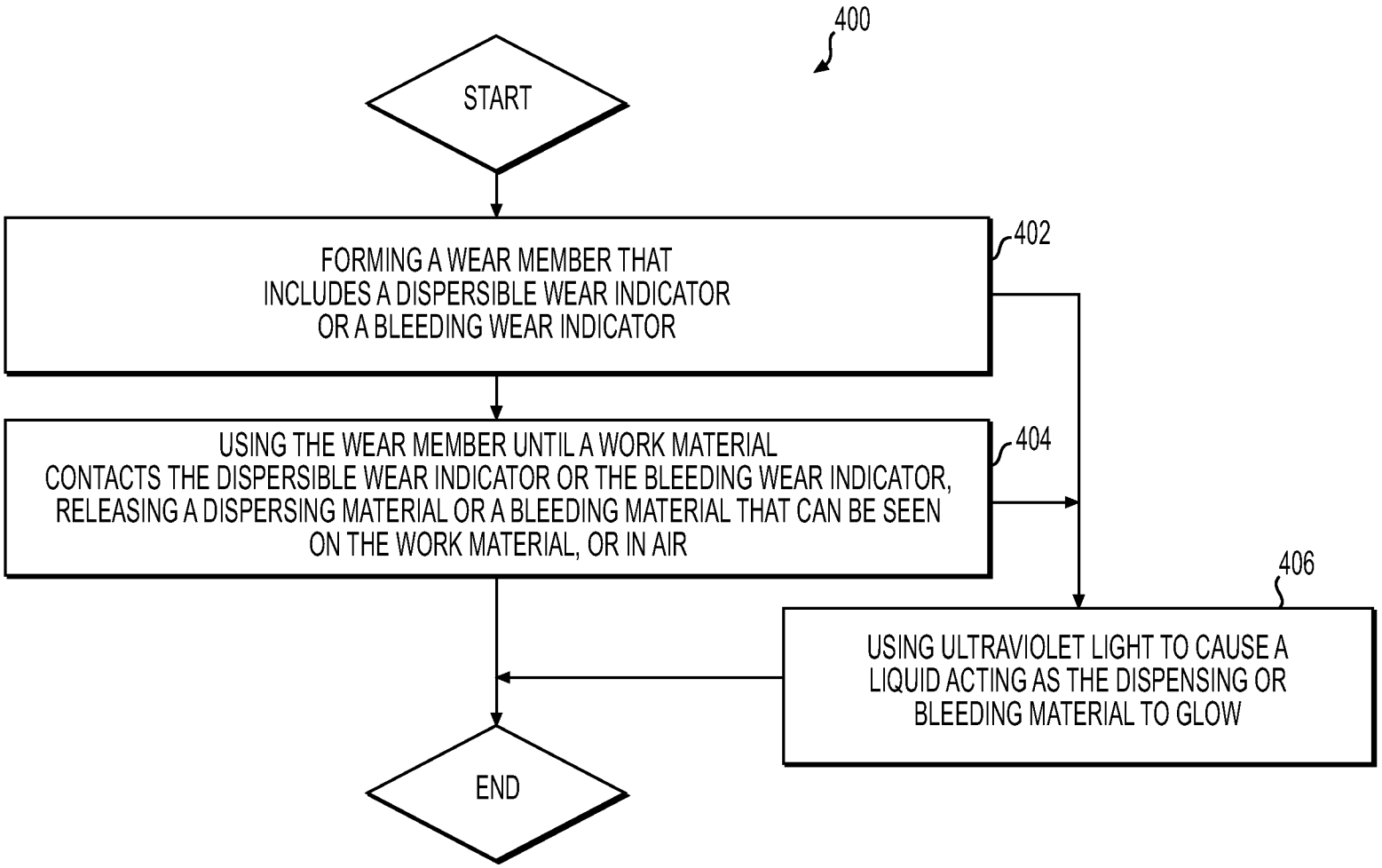
FIG. 7 contains a flowchart depicting a method of use according to an embodiment of the present disclosure.

FIG. 7 discloses a method 400 of alerting an operator that a wear member needs to be replaced that may comprise the following steps:

- forming a wear member that includes a dispersible wear indicator or a bleeding wear indicator (step 402); and
- using the wear member until a work material contacts the dispersible wear indicator or the bleeding wear indicator, releasing a dispersing material or bleeding material that can be seen on the work material, or in air (step 404).

In some embodiments, the bleeding or dispersing material may comprise a liquid that will glow when ultraviolet light is shown on it (may be referred to as a "UV glowing liquid" (step 406). To that end, UV lights 126 may be supplied at the rear of the machine as shown in FIG. 1 so that the liquid will glow and be seen behind the machine.

The nature of this dispersible or bleeding material allows it to be left behind or to egress away from a hidden wear member, giving notice that the wear member may need servicing without necessitating disassembly of the machine, or assembly to which the hidden wear member is attached. This may avoid unnecessary downtime for the machine.

As used herein, the articles "a" and "an" are intended to include one or more items, and may be used interchangeably with "one or more." Where only one item is intended, the term "one" or similar language is used. Also, as used herein, the terms "has", "have", "having", "with" or the like are intended to be open-ended terms. Further, the phrase "based on" is intended to mean "based, at least in part, on" unless explicitly stated otherwise.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A wear member comprising:

an attachment portion;

a wear portion extending from the attachment portion that defines a wear surface; and a bleeding wear indicator disposed in the wear portion and spaced a predetermined distance away from the wear surface, wherein the bleeding wear indicator comprises a dissolvable solid, the dissolvable solid dispersing to a working material upon contacting moisture in the working material to indicate that the wear member needs to be repaired or replaced.

2. The wear member of claim 1, wherein the bleeding wear indicator further comprises at least one of:

a paint, a polymer, or a fluid.

3. The wear member of claim 2, wherein the fluid comprises at least one:

a UV glowing liquid, or a colored gas visible in a vicinity of a work area upon exposure indicating the wear member needing to be repaired or replaced.

4. The wear member of claim 1, wherein the bleeding wear indicator is disposed nearer the attachment portion as opposed to the wear surface.

5. The wear member of claim 1, wherein the attachment portion defines an attachment portion width, and the wear portion defines a wear portion width that is greater than the attachment portion width.

6. The wear member of claim 5, wherein the wear member has an at least partially "T shape" in a cross-section parallel to the wear portion width and the attachment portion width.

7. The wear member of claim 5, wherein the attachment portion is disposed at a midpoint along the wear portion width.

8. A skid for use with a cold planer assembly, the skid comprising:

a sliding portion including a sliding surface;

a connecting portion extending from the sliding portion that is thinner than the sliding portion; and a first dispersible wear indicator disposed in the sliding portion and positioned away from the sliding surface, wherein the first dispersible wear indicator comprises a dissolvable solid, the dissolvable solid dispersing to a working material upon contacting moisture in the working material to indicate that the skid needs to be replaced.

9. The skid of claim 8, further comprising a ramp portion extending from the sliding portion at an oblique angle to the sliding portion.

10. The skid of claim 9, wherein the ramp portion includes a second dispersible wear indicator that is disposed in the ramp portion.

11. The skid of claim 10, wherein the ramp portion includes a push surface, and the second dispersible wear indicator is spaced away from the push surface.

12. The skid of claim 8, wherein the sliding portion includes a top exposed surface, and the first dispersible wear indicator is disposed at the top exposed surface of the sliding portion proximate to the connecting portion.

13. The skid of claim 9, wherein the first dispersible wear indicator has an elongated racetrack perimeter.

14. The skid of claim 9, wherein the first dispersible wear indicator further comprises at least one:

a paint, a polymer, a fluid.

15. The skid of claim 9, wherein the connecting portion includes a plurality of thru-holes.

16. The skid of claim 10, wherein:

the first dispersible wear indicator is symmetrical to the second dispersible wear indicator about a first plane of symmetry, and the skid further comprises a third dispersible wear indicator and a fourth dispersible wear indicator, the third dispersible wear indicator and the fourth dispersible wear indicator being symmetrical to the first dispersible wear indicator and the second dispersible wear indicator about a second plane of symmetry.

17. The skid of claim 16, wherein the second dispersible wear indicator comprises one of:

a paint, a polymer, a dissolvable solid, or a fluid.

18. The skid of claim 16, wherein the third dispersible wear indicator comprises:

a UV glowing liquid dispersing to the working material upon contacting the working material to indicate under UV lights that the wear member needs to be replaced, or a colored gas visible in a vicinity of a work area upon exposure indicating the wear member needing to be repaired or replaced.

19. A method of alerting that a wear member needs to be replaced comprising:

forming a wear member that includes a bleeding wear indicator, wherein the bleeding wear indicator comprises a dissolvable solid, the dissolvable solid dispersing to a working material upon contacting moisture in the working material to indicate that the wear member needs to be replaced.

20. The method of claim 19, wherein the wear member further includes a dispersible wear indicator, the method further comprising:

upon the work material contacting the dispersible wear indicator, releasing a dispersing material visible in a vicinity of a work area.

21. The method of claim 20, further comprising using ultraviolet light to cause a liquid acting as the dispersing material or the bleeding material to glow.

* * * * *